United States Patent [19]

Harley

[11] Patent Number: 4,830,323

[45] Date of Patent: May 16, 1989

[54] SHELF SUPPORT

[75] Inventor: David N. Harley, Bournemouth, England

[73] Assignee: Titus Tool Co., Ltd., England

[21] Appl. No.: 183,714

[22] Filed: Apr. 19, 1988

[51] Int. Cl.[4] ..... A47B 57/30

[52] U.S. Cl. ..... 248/250; 248/243; 108/108

[58] Field of Search ..... 248/250, 235, 239, 243, 248/241, 231.9; 108/108, 109; 211/187, 153, 186

[56] References Cited

U.S. PATENT DOCUMENTS

| | | | |
|---|---|---|---|
| 1,877,196 | 9/1932 | Parker | 248/250 |
| 3,471,112 | 10/1969 | MacDonald et al. | 248/250 X |
| 3,870,266 | 3/1975 | MacDonald . | |
| 4,037,813 | 7/1977 | Loui et al. | 248/250 |
| 4,053,132 | 10/1977 | Del Dozzo | 248/250 X |
| 4,432,523 | 2/1984 | Follows | 248/250 X |
| 4,666,117 | 5/1987 | Taft | 211/187 X |

FOREIGN PATENT DOCUMENTS 1540224 2/1979 United Kingdom .

*Primary Examiner*—Robert W. Gibson, Jr.
*Assistant Examiner*—Karen J. Chotkowski
*Attorney, Agent, or Firm*—Lowe, Price, LeBlanc, Becker & Shur

[57] ABSTRACT

A shelf support (10) for supporting a shelf perpendicular to a cabinet wall is disclosed. The shelf support comprises a body portion (20) provided with a post (32) by which the shelf support can be secured to the cabinet wall with the back of the body portion against the wall, a ledge member (12) projecting from the front of the body portion (20) for supporting the edge portion of a shelf, and an upper portion (16) carried by the body portion and having a shelf-engaging edge (18) which projects outwardly from the front of the body portion and is spaced from the ledge by substantially the thickness of the shelf whereby the shelf can be supported on the ledge and engaged from above by the shelf-engaging edge (18). The body portion (20) includes two limbs (22, 24) which support the upper portion (16) at its lateral extremeties, and the upper portion includes a V-shaped part which provides the shelf-engaging edge (18). The peak of the V of the V-shaped part lies forward of the body portion with said V-shaped part adapted to be flattened by pressure from the front such that the shelf-engaging edge (18) moves substantially perpendicularly to the body portion (20) and the cabinet wall and the two limbs (22, 24) being adapted to twist and be forced apart to accommodate said flattening, whereby when the V-shaped part is released the shelf-engaging edge (18) returns to its original position by movement substantially perpendicular to the body portion.

7 Claims, 3 Drawing Sheets

SHELF SUPPORT

This invention relates to a shelf support for supporting a shelf substantially perpendicular to a cabinet wall.

It is often desirable to provide cabinets with means by which the position of the shelves can be easily adjusted and which cabinet can be transported with the shelves installed without them becoming loose, and thereby potentially causing damage to the inside of the cabinet, during transportation.

To this end a number of solutions have been proposed which combine the functions of shelf support and shelf anchorage with varying degrees of complexity and success. Many of the prior art documents disclose a shelf support in which a supporting ledge projects from a body portion for supporting an edge portion of a shelf and a securing projection which extends away from the body portion above the supporting ledge to engage with an upper surface of the shelf edge portion thereby anchoring the shelf in place. Indeed U.S. Pat. No. 4,666,117 (Taft) discloses a "low profile shelf lock" which meets these requirements and which is further adapted so that the top half of the body is displaced temporarily so as to lie flat against the cabinet wall when a shelf is being secured therein. During the securing process of the Taft disclosure the securing projection, which is a crescent projection, is resiliently deformed by the shelf as it moves toward the shelf support. Upon the shelf reaching the shelf support the securing projection snaps back to its original shape so that its shelf engaging edge rests on top of the shelf. But the securing projection of the Taft disclosure is arranged such that the shelf engaging edge, in snapping back to its original position, would pivot away from the top of the shelf about some undefined point above the shelf support. The main effect of this is that with the shelf in position the shelf engaging edge would inevitably be positioned above and away from the top of the shelf. In order to overcome this problem Taft proposes a body portion formed of two integral halves joined to one another at an angle. This arrangement provides a second pivoting movement of the upper half of the body portion which is intended to counteract the pivotal movement of the shelf engaging edge. However, in order for the Taft disclosure to work at maximum utility the thickness of the shelf and its length between shelf supports must be within a strict tolerance. If the shelf is too thick the shelf engaging edge will fail to contact the upper surface of the shelf; if the shelf is slightly under-length of upper half of the body portion may not pivot sufficiently to bring the shelf engaging edge into contact with the upper face. Similarly, if the shelf is too thick or too long, corresponding problems may arise.

The present invention aims to overcome the above disadvantages by providing a shelf support in which a shelf engaging edge moves substantially perpendicularly to the body portion in returning to its original position once a shelf has been inserted.

According to the present invention there is provided a shelf support for supporting a shelf perpendicular to a cabinet wall, the shelf support comprising a body portion provided with means by which the shelf support can be secured to the cabinet wall with the back of the body portion against the wall, a ledge projecting from the front of the body portion for supporting the edge portion of a shelf, and an upper portion carried by the body portion and having a shelf-engaging edge which projects outwardly from the front of the body portion and is spaced from the ledge by substantially the thickness of the shelf whereby the shelf can be supported on the ledge and engaged from above by the shelf-engaging edge, the body portion including two limbs which support the upper portion at its lateral extremeties, characterised in that the shelf-engaging edge is on a substantially V-shaped part of the upper portion, the peak of the V lying forwardly of the body portion, and said V-shaped part is adapted to be flattened by pressure from the front such that the shelf-engaging edge moves substantially perpendicularly to the body portion and the cabinet wall, the two limbs being adapted to twist and be forced apart to accommodate said flattening, whereby when the V-shaped part is released the shelf-engaging edge returns to its original position by movement substantially perpendicular to the body portion.

Preferably the shelf engaging edge is inclined with respect to the ledge so as to accommodate different thickness of shelves.

A resilient hinging portion can be advantageously provided at the peak of the V to assist the V-shaped part in returning to its original position after said flattening.

The upper portion of the shelf support may include an inclined lead-in surface which extends from the back of the body portion to the peak of the V thereby facilitating said flattening during insertion of the shelf.

In order to enable the two limbs to twist and be forced apart, during insertion of the shelf, without them bowing out from the wall, end portions of the two limbs preferably taper towards the upper portion.

The component parts of the shelf support can be formed integrally from a plastics material.

In order that the invention may be understood, an embodiment thereof will be described, by way of example only, with reference to the accompanying drawings, in which.

Figure 1:
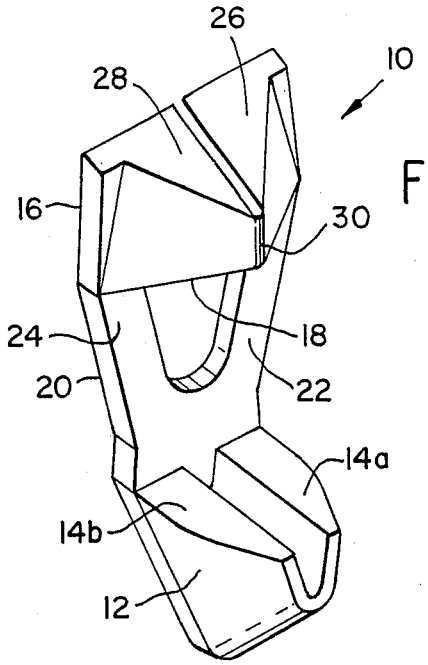
FIG. 1 shows a perspective view of a shelf support in accordance with the present invention.

Referring now to FIG. 1, a shelf support generally indicated at 10 comprises a ledge member 12 which provides two supporting surfaces 14*a*, 14*b* for supporting an edge portion of a shelf in use, and an upper portion 16 which includes a V-shaped (as seen from below - see FIG. 4(*a*)) part protruding away from the main body 20 of the shelf support, there being a shelf engaging edge 18 on the V-shaped part. The V-shaped part is spaced from the supporting surfaces 14*a*, 14*b* by substantially the thickness of the shelf to be supported therein. The main body 20 of the shelf support comprises two limbs 22, 24 which adjoin the ledge member 12 and the upper portion 16. The two limbs 22, 24 extend away from the ledge member 12 and diverge to join with lateral extremities of the upper portion 16. The upper portion 16 itself comprises two halves 26, 28 which are joined at their frontmost inner edge by a hinging portion 30 which helps to return the upper portion 16 to its original V-shape after insertion of the shelf in use.

Figure 3:
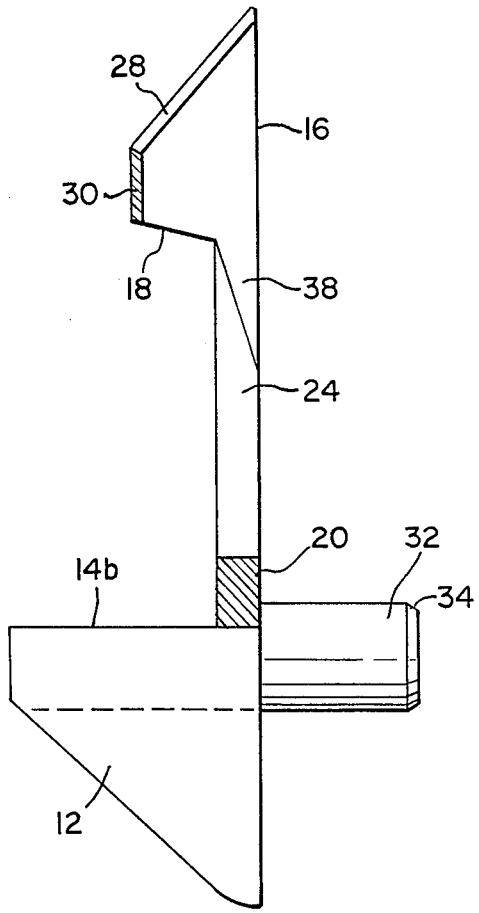
FIG. 3 shows a sectional view of the support along the line III—III in FIG. 2.
Figure 2:
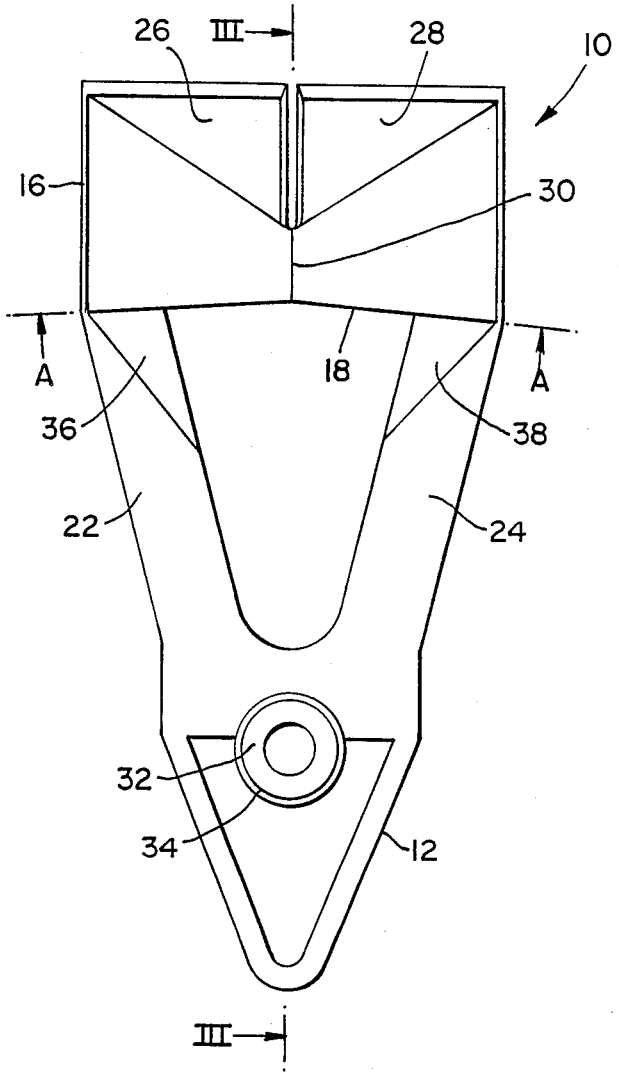
FIG. 2 shows a rear view of the shelf support.

As can be seen in FIGS. 2 and 3 the shelf support 10 further comprises a post 32 which extends substantially perpendicularly from the back of the main body 20 about an axis lying on or below the plane of the supporting surfaces 14*a*, 14*b* and is dimensioned to fit snugly into a receiving hole in a cabinet wall (not shown) so that the back face of the shelf support lies flat against the cabinet wall. For ease of insertion into the said hole the post may include a chamfered edge 34. FIG. 2 also shows that the two limbs 22, 24 each have a cut-away portion 36, 38 which taper to meet with edge portions of the lateral extremities of the respective halves 26, 28 of the upper portion 16. The cut-away portions 36, 38 and also be seen in FIGS. 3 and 4(*a*). It should be noted that, as shown in FIG. 3, the shelf engaging edge 18 inclines away from the perpendicular to the main body so that the shelf support will be able to accommodate shelves within a predetermined tolerance of thickness.

Figure 4A:
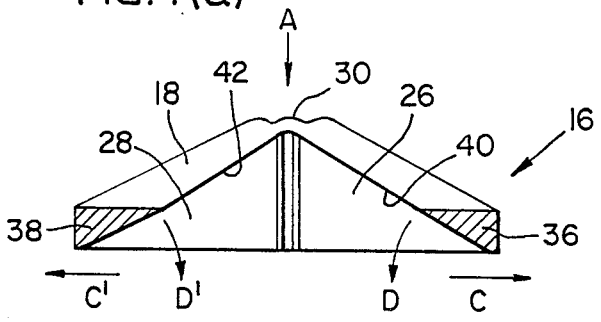
FIG. 4 shows *a*) a sectional view along the line A—A in FIG. 2 and *b*) a front view of the upper portion of the shelf support.
Figure 4B:
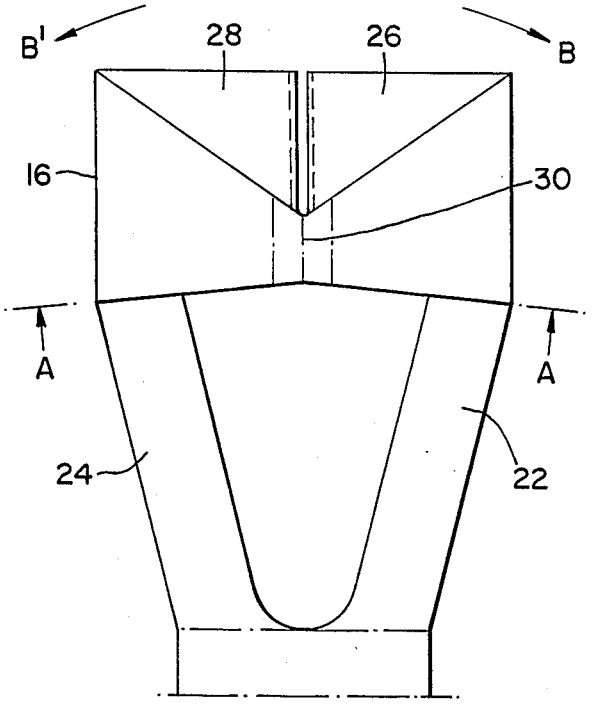

Referring now to FIG. 4(*a*) the upper portion 16, which comprises the two halves 26, 28 is joined by the hinging portion 30 to form a substantially V-shaped part which will flatten against the surface of the cabinet wall (not shown) when a shelf edge portion is being inserted into the support 10 and which will return substantially to its original V-shaped form once the shelf edge portion has been fully inserted into the support.

When a shelf is being inserted into a cabinet in which the shelf support is being used, an edge portion of the shelf will first make contact with the substantially triangular upper surfaces of the two halves 26, 28. As pressure is applied to these surfaces by the edge portion of the shelf, the upper portions of the halves will move apart in the direction of arrows B and B′ in FIG. 4(*b*). Simultaneously, the V-shaped form of the upper portion 16 will flatten as the force is applied substantially in the direction of arrow A in FIG. 4(*a*). This causes at least the tapered end portions 36, 38 of the two limbs 22, 24 to move out in the direction of the arrows C, C′ whilst twisting about themselves as shown by the arrows D, D′. This action continues, depending on the width of the shelf, as the shelf edge portion is inserted further into the shelf support and is only limited by the inner surfaces 40, 42 of the two halves contacting the wall of the cabinet. This relationship between the limbs 22, 24 and the upper portion 16 ensures that the shelf retaining edge and the hinging portion 30 move in towards the cabinet wall along a path which is substantially perpendicular thereto.

Once the shelf edge portion has passed fully over the upper portion of the shelf support, the two halves 26, 28 return substantially to their original V-shaped form as the limbs 22, 24 untwist and the hinging portion 30 springs back out. Because the shelf engaging edge 18 is inclined away from the perpendicular, the substantially linear movement of the upper portion outwards towards its original V-shaped form will only continue until part of the shelf engaging edge 18 comes into contact with an edge portion of the shelf. In this way, there is greater certainty that the shelf engaging edge 18 will actually contact the shelf edge portion, rather than moving arcuately away from it which was the problem in the prior art.

In order to ensure that the upper portion 16 will return to substantially its original form and that the limbs 22, 24 can twist and untwist when the shelf is being inserted, the shelf support should be made from a resilient material. In the preferred embodiment the shelf support is made in a single moulding process from a resilient plastics material.

The invention having thus been described, it will be apparent to those skilled in the art that modifications are possible without departing from the ambit of the invention. For example, the hinging portion 30 is not absolutely essential to the working of the invention, although it is preferably included to facilitate the upper portion in returning to its original form after the V-shaped part has been flattened during insertion of the shelf. Similarly, the ledge member 12 need not provide two supporting surfaces; a single supporting surface of any substantially planar form may instead be provided. Other modifications are possible which fall within the scope of the present invention and it is intended that the described embodiment should not be interpreted in a limiting sense. The scope of the invention is defined with particularlity in the claims.

I claim:

1. A shelf support for supporting a shelf perpendicular to a cabinet wall, the shelf support comprising a body portion provided with means by which the shelf support can be secured to the cabinet wall with the back of the body portion against the wall, a ledge projecting from the front of the body portion for supporting the edge portion of a shelf, and an upper portion having two side edges, said upper portion being carried by the body portion and having a shelf-engaging edge which projects outwardly from the front of the body portion and is spaced from the ledge by substantially the thickness of the shelf whereby the shelf can be supported on the ledge and engaged from above by the shelf-engaging edge, the body portion including two limbs which support the upper portion at the two side edges thereof, wherein the shelf-engaging edge is on a substantially V-shaped part of the upper portion, the peak of the V-shaped part lying forwardly of the body portion, the V-shaped part comprising two halves interconnected by a hinging portion at the peak of the V-shaped part, the hinging portion lying in a line substantially parallel to the back of the body portion such that said V-shaped part can be flattened by pressure from the front so as to cause the shelf-engaging edge to move substantially perpendicularly to the body portion and the cabinet wall, the two limbs being adapted to twist and be forced apart to accommodate said flattening, whereby, when the V-shaped part is released, the shelf-engaging edge returns to its original position by movement substantially perpendicular to the body portion.

2. A shelf support according to claim 1, wherein the shelf-engaging edge is inclined with respect to the direction perpendicular to the body portion.

3. A shelf support according to claim 2, wherein the upper portion has an inclined lead-in surface which extends from the back of the body portion to the peak of the V-shaped part thereby facilitating said flattening during insertion of the shelf.

4. A shelf support according to claim 3, wherein end portions are provided on the two limbs which taper towards the upper portion, so that the limbs can twist and be forced apart without bowing out from the wall.

5. A shelf support according to claim 4, wherein the component parts thereof are formed integrally from a plastics material.

6. The shelf support according to claim 1, wherein said two halves are spaced from each other by a slot and are connected together by said hinging portion disposed beneath said slot.

7. The shelf support of claim 1, wherein a back surface of an upper portion of the back of the body portion is formed substantially coplanar with a back surface of the back of said body portion, whereby the only movable portion of said shelf support during installation of a shelf thereon is flattening by pressure of the V-shaped part and twisting of said two limbs to accommodate said flattening.

* * * * *

UNITED STATES PATENT AND TRADEMARK OFFICE

CERTIFICATE OF CORRECTION

PATENT NO. : 4,830,323

DATED : May 16, 1989

INVENTOR(S) : David N. HARLEY

It is certified that error appears in the above-identified patent and that said Letters Patent is hereby corrected as shown below:

Column 1, line 51, change "of upper" to --the upper--;

Column 3, line 11, change "and also" to --can also--.

Signed and Sealed this

Fifteenth Day of May, 1990

*Attest:*

HARRY F. MANBECK, JR.

*Attesting Officer*

*Commissioner of Patents and Trademarks*